US005500495A

United States Patent [19]

Benda et al.

[11] Patent Number: 5,500,495

[45] Date of Patent: Mar. 19, 1996

[54] CIRCUIT BREAKER LOCKOUT DEVICE FOR ATTACHMENT TO SOLID SWITCH STEM

[75] Inventors: Steven J. Benda, Cokato, Minn.; John P. Pearson, Milwaukee, Wis.

[73] Assignee: Brady USA, Inc., Milwaukee, Wis.

[21] Appl. No.: 183,925

[22] Filed: Jan. 18, 1994

Related U.S. Application Data

[63] Continuation-in-part of Ser. No. 9,168, Jan. 26, 1993, abandoned.

[51] Int. Cl.[6] ..... H01H 9/28

[52] U.S. Cl. ..... 200/43.14; 200/43.21; 200/43.22

[58] Field of Search ..... 200/43.13, 43.14, 200/43.11, 43.16, 43.18, 43.19, 43.21, 43.22, 43.15

[56] References Cited

U.S. PATENT DOCUMENTS

| | | | |
|---|---|---|---|
| 2,795,663 | 6/1957 | Estes | 200/43.21 |
| 4,978,816 | 12/1990 | Castonguay et al. | 200/43.14 |
| 5,079,390 | 1/1992 | Costanzo et al. | 200/43.14 |
| 5,122,624 | 6/1992 | Benda | 200/43.14 |
| 5,147,991 | 9/1992 | Jordan, Sr. | 200/43.14 |

FOREIGN PATENT DOCUMENTS

| | | | |
|---|---|---|---|
| 172771 | 2/1986 | European Pat. Off. | 200/43.11 |
| 765724 | 1/1957 | United Kingdom | 200/43.21 |
| 1451954 | 10/1976 | United Kingdom | 200/43.22 |

OTHER PUBLICATIONS

Breaker Lock™ S–Y–A–1 Brochure, Toloc Systems, Houston, Texas Distributed National Safety Congress Show Oct. 4–7, 1993.

*Primary Examiner*—Renee S. Luebke
*Attorney, Agent, or Firm*—Quarles & Brady

[57] ABSTRACT

A device particularly suited for blocking access and locking out a circuit breaker or other switch of the type having a solid stem without holes, which includes a base having an opening for positioning on the switch base and receiving the switch stem, a clamping member, and a thumb screw for operation with the clamping member to clamp the device onto the switch stem to immobilize it. The device further includes a cover which is pivoted over a structure forming an aperture for receiving a lock shackle, the cover blocking operation of the thumb screw when the lock shackle is positioned and secured in said aperture.

8 Claims, 2 Drawing Sheets

CIRCUIT BREAKER LOCKOUT DEVICE FOR ATTACHMENT TO SOLID SWITCH STEM

This application is a continuation-in-part of application Ser. No. 08/009,168, filed Jan. 26, 1993, and now abandoned.

BACKGROUND OF THE INVENTION

1. Field of the Invention

The field of the invention is devices for blocking out and locking out operation of circuit breakers and other switches.

2. Background Art

In my prior patent, U.S. Pat. No. 5,122,624, issued Jun. 16, 1992, there is a general description of circuit breakers and devices for preventing their operation. Such devices are more generally identified as block-outs, when they block operation of the switch. When such devices are further secured by a padlock, they are also referred to as lock-outs. Such lock-outs may be included under the broad definition of block-out devices.

Costanza, et al., U.S. Pat. No. 5,079,390, shows a lock-out device for attachment to a solid switch stem, sometimes referred to as a "no-hole" circuit breaker switch stem. This lock-out device has a rigid block with a passage therethrough in which a set screw is inserted to grip a switch stem. A second passage intersects this screw passage behind the screw, so as to permit insertion of a lock shackle to lock out access to the screw.

Jordan, Sr., U.S. Pat. No. 5,147,991, shows another such device including a block, a screw threaded through a portion of the block to grip a switch stem and a slideable cover which is moved into position to block access to the screw and to align a pair of apertures in the body and the cover. A lock shackle fits through these aligned apertures to lock the cover in place and prevent access to the screw.

Such prior devices have a disadvantage of contacting the switch stem directly with the screw. It would be advantageous to distribute the forces applied to the switch stem.

Such devices also require the use of tools for moving the screw, rather than being operable by hand and without the use of such tools.

Such prior devices place the lock in a location which can provide a considerable rotational torque on the switch stem.

There is a need in the art for an improved no-hole lock-out device which is easy to install, low in manufacturing cost, and compact in size.

There is also a need for a device which improves the method of attachment to the switch stem and location of the lock relative to the switch stem.

SUMMARY OF THE INVENTION

The invention relates to a block-out device which can be more easily attached to a solid switch stem than the devices of the prior art and conveniently locked in place with a padlock.

The block-out device more particularly includes a base with an opening for receiving a switch stem, a clamping member which is movable relative to the base and the switch stem, and a screw insertable through the base and into the clamping member, wherein the screw moves the clamping member against the switch stem to grip and immobilize the switch stem. A cover is movable between an open position and a closed position and the block-out device includes structure forming an aperture which projects through the cover in its closed position, so that a lock can be inserted through the aperture to hold the cover down in position where it shields an operational end of the screw from access.

The invention improves installation by providing a thumb screw that includes a knob for manual operation of the screw without additional tools.

The structure forming the aperture may be attached to the base or to the screw. The cover may also be hinged to the base to prevent the parts from becoming lost or separated.

The invention further improves the operation of the clamping member by providing means for distributing the forces of the screw. In one embodiment, the clamping member provides a wall interposed between one end of the screw and the switch stem. In another embodiment, the clamping member has a metal edge member that extends across the switch stem and is pulled into contact with the switch stem to hold it more securely.

The cover includes two flaps which are joined at an angular corner thereby permitting the cover to wrap around the portion of the base and provide a compact lock-out device.

The invention provides a device in which the lock is located over the switch stem so as to remove the rotational torque that would be applied to the switch stem with the lock in other locations.

Other objects and advantages, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention and, therefore, reference is made to the claims which follow description for determining the scope of the invention.

DETAILED DESCRIPTION OF PREFERRED AND ALTERNATIVE EMBODIMENTS

Figure 1:
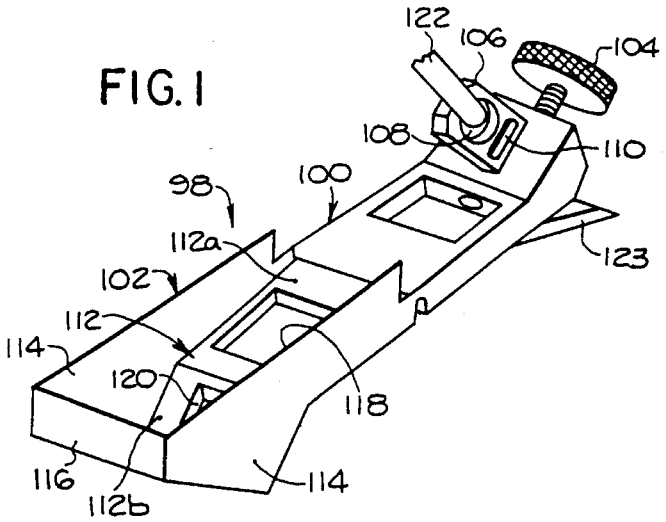
FIG. 1 is a perspective view of a first embodiment of the invention, oriented according to FIG. 1.
Figure 2:
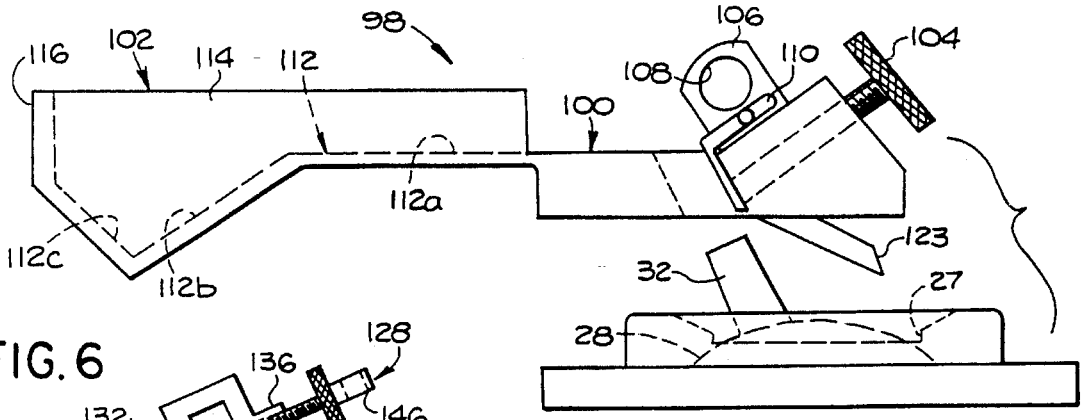
FIG. 2 is a side view elevation of the device of FIG. 1, in association with a switch.

Referring to FIGS. 1 and 2, the lock-out device 98 of the invention is used with a circuit breaker switch indicated at 22. For convenience, the switch 22 will be described first to more clearly show the relationship of the lock-out with the switch. The member 22 may be referred to as a circuit breaker, or circuit breaker switch, and very often in the trade, is referred to simply as a switch. In the present case, it will also be referred to as a switch. The switch 22 includes a base or wall element 24 having an exposed or outer flat surface 25, and a depression 26 formed therein. The elements defining the depression 26 include an element 27 which forms an abrupt abutment utilized in the locking functions. The switch 22 includes an actuating member 28 which connects to an internal switching component and is rockable or oscillatable about a pivot axis traversing the face 25. The actuating member 28 and stem 32 are movable to opposite positions in which the stem 32 resides in an "OFF" position shown, or in an opposite ON position angularly spaced therefrom. The stem 32 in each position is at an acute angle to the face 25, which is significant in the function of locking the stem in the intended position, i.e. the "OFF" position, represented in FIG. 1. The elements defining the depression 26 include the abrupt abutment element 27 (FIG. 2) which is utilized in locking the switch 22 in the "OFF" position. As the description proceeds, it will be noted that the lock-out 20, when fitted to the switch 22, engages the flat surface of face 25, to assist the locking function.

Typically, in use, the lock-out 20 and switch 22 are oriented accordingly in a vertical direction. It will be understood that the device 20 may be used in association with a switch oriented in any of various positions and the description is to be interpreted accordingly.

Figure 3:
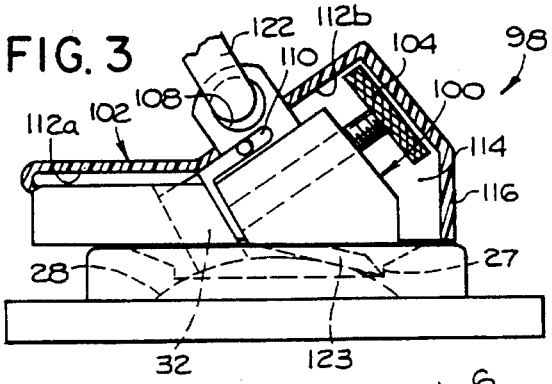
FIG. 3 shows the device of FIGS. 1 and 2 applied to the switch with the cover in the closing position.

As seen in FIGS. 1, 2 and 3, the lock out 98 includes a base 100 and cover 102 corresponding to similar members in the previous form. On the upper surface of the base 100 is a flat-sided lug 106. In the present case, the flat-sided lug 106 has a transverse hole 108 through it and a slot 110 below the hole 108 extending substantially parallel with the shank of the thumb screw 104. The cover 102 has a top element 112 including three angular elements 112*a*, 112*b*, 112*c* and side walls 114, 116. The top element 112 has openings 118, 120.

The lock-out 98 in this case is applied to the switch 22 by first fitting the base 100 to the switch 22, using foot 123 placed in depression 27 to anchor the device 98 against moving switch stem 32 and actuating element 28. The thumb screw 104 is advanced against a pressure plate 40 and the switch stem 32, and then the cover 102 is pivoted to a closed position. In this last movement, the opening 118 receives the upper extended end of the switch stem 32, maintaining visual confirmation of the OFF position and the opening 120 receives the lug 106. It is to be noted that the opening 120 is of a size and rectangular shape to receive the lug 106.

With the cover in the closed position in FIG. 3, the side walls 114, 116 surround and effectively enclose the angled surfaces and vertical sidewalls of the base 100. The walls 114 extend down to a position at, or adjacent to, the under surface of the base 100 and the elements of the cover, 112*b*, 112*c*, 116 and 114 cover the thumb screw 104. The lug 106 extends through the opening 120 so that the hole 108 extends to the exterior, where a shackle 122 of a lock can be inserted for locking the cover 102 in place.

Figure 6:
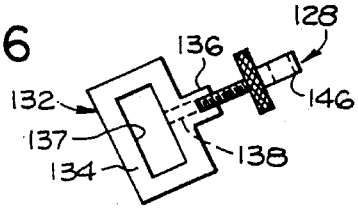
FIG. 6 is a view of a thumb screw and slide taken in a plane indicated by line 6—6 of FIG. 4.
Figure 5:
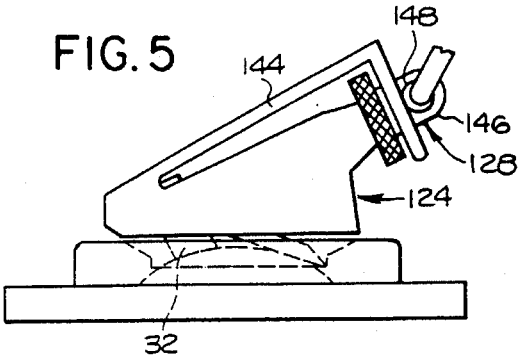
FIG. 5 is a side view in elevation of the device of FIG. 4 showing the cover in the closed position.
Figure 4:
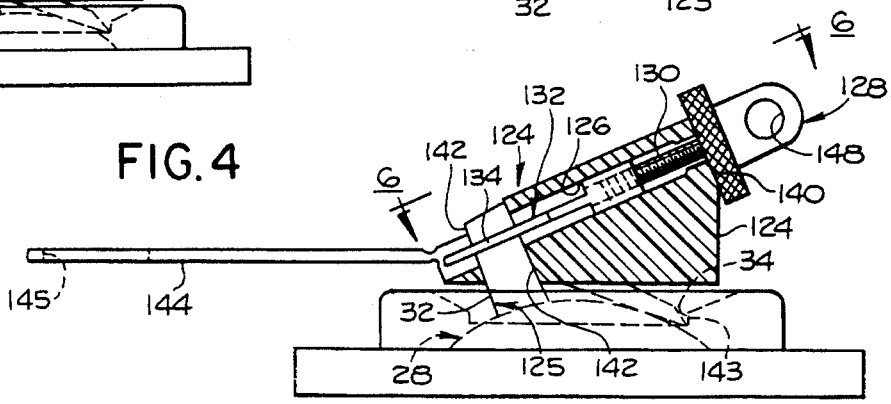
FIG. 4 is a longitudinal sectional view of a second embodiment of the device applied to the switch.

Another form of lock-out is shown in FIGS. 4–6. In this case, the lock-out indicated at 123 includes a base 124 having an opening 125 receiving the switch stem 32, and having a slide hole 126. A thumb screw 128 has a shank 130 extending into the slide hole 126 in free sliding or non-threaded relation. A sliding, clamping member 132 is provided, having a loop 134 and a lug 136 with a threaded hole 138 therein. The clamping member 132 is preferably flat, plate-like, and the abutment 136 slides in the screw hole. The shank 130 of the thumb screw 128 threads into the hole 138. The loop has an edge 137, substantially in the form of a line, engaging the switch stem. This edge 137 extends fully across the width of the switch stem 32, distributing the force throughout that dimension and reducing stress on the switch stem 32. The loop 134 provides a single lock-out for use with switch stems of different widths.

In applying the lock-out 124 to the switch 22, the base 124 is fitted thereto and the switch stem 32 is extended through the loop 134. Upon turning the thumb screw 128, it exerts a pulling force on the clamping member 132 which in turn transmits that pulling force to the switch stem 32. The knob end of the screw 128 reacts against the forward end 140 of the lock-out 124 while the switch stem 32 reacts against the surface 142 of the hole 125, securely locking the lock-out 124 to the switch stem 32 and thus to the switch 22. In this position, the lock-out 124 rests on the surface of the switch 22, and the switch 22 is locked in place. In this case also, the base may be provided with a foot 143.

The lock-out has a cover 144, swingable into a closed position (FIG. 15) over the base of the lock-out, and the end portion of the cover 144 has a slot receiving the lug 146 of the screw. In this case also, the lug 146 has a hole 148 for receiving the element of a lock. Cover 144 will bend at hinge 144*a*.

FIGS. 7–10 show a preferred embodiment of the present invention. The lock-out includes a base 150, a cover 160, a thumb screw 170 and a slide member 173. In this embodiment, a lug 156 is formed on the base 150 similar to lug 106 (FIG. 1).

The base 150 more particularly includes an undersurface 151, first angular surfaces 152 and second angular shoulder surfaces 154 which meet in an apex. Surfaces 152, 154 each form an acute angle with switch base 22. Vertical surface 159 runs into surface 153, which is oriented perpendicular to downwardly angled, threaded shaft 172 of thumb screw 170.

The slide member 173 slides within a cavity in base 150. The slide member 173 includes a cylindrical lug portion 179 (FIG. 9) with a threaded bore (FIG. 18) for receiving threaded stem 172 of thumb screw 170. The thumb screw 170 has a disc-shaped plastic knob 171 with a knurl formed by parallel ridges around the periphery of the top portion of the knob 171 to provide for a better grip.

The slide member 173 more particularly includes two legs 174, 175 (FIG. 19) which are connected by cross-pieces similar to slide 132 in FIG. 6. The lower cross-piece 176 carries a metal edge member 177 which extends laterally across switch stem 32 and which is pulled into contact therewith for distributing clamping forces.

Figure 8:
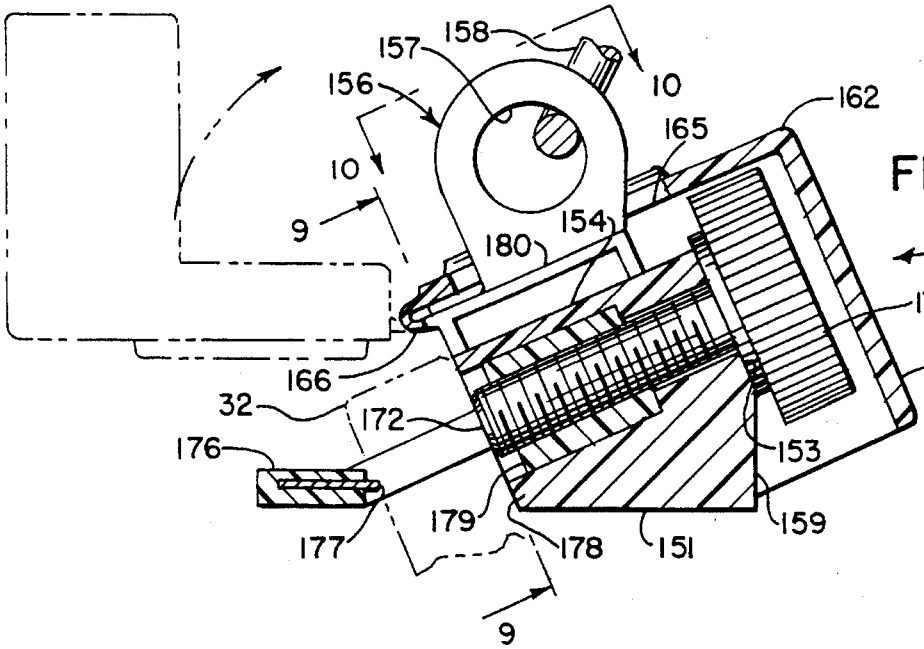
FIG. 8 is a side view of the device of FIG. 7, with parts shown in phantom and section.

The lock-out device is applied to the switch in a manner similar to that described above for the other embodiments, by first fitting the switch base 150 onto the switch 22, operating the knob end 171 of the thumb screw 170 to pull clamping member 173 and its edge member 177 into engagement with the switch stem 32. The undersurface 151 of the base 152 prevents the switch stem 32 from being rotated from its "OFF" position seen in FIG. 8. The undersurface of cross-member 176 cooperates with under surface 151 and prevents the switch stem 32 from being moved from its "OFF" position while being clamped in its immobilized position. As seen in FIG. 8, the tip of the screw 172 bears against the stem 32, but stem 32 could also be held against reaction surface 178. Once the lock-out is in position and the thumb screw 170 is in its position engaging the switch stem 32, the cover 160 is placed over the lug 156.

The cover 160 is hinged by a flexible hinge portion 166 which joins the cover 160 in the base 150 and prevents the parts from becoming lost or separated. The cover 160 has angular walls 161, 162 which meet at a right angle apex. The cover 160 also has upper side flaps 163 extending down from wall 162 and forward side flaps 164 extending from wall 161 to an angle surface 152 which rises to meet angle surface 154 at a right angle apex that fits within an inverted "L" formed by flaps 163 and 164 of cover 160. Thus, it can be seen that the cover 160 closes down and around thumb screw 170 to prevent access thereto. The cover 160 also has an aperture 165 (FIGS. 8 and 10) which allows lug 156 to extend upwardly therethrough and expose through-hole 157, so that when the cover is moved to its closed position, a lock shackle 158 can be placed in through-hole 157 to secure the cover 160 in place and prevent access to the thumb screw 170 and removal of the lock-out device. Lug 156 is supported by a raised platform 180 which rises above surfaces 15.

This has been a description of several embodiments of how the invention can be carried out, Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

We claim:

1. A block-out device, for positioning over a switch, having a switch stem with solid portion and a switch base, the block-out device having structure forming an aperture for receiving a lock, the block-out device comprising:

a base having two angular surfaces joined at an apex and having an opening for receiving the switch stem when the base is positioned on the switch base with the angular surfaces each forming an acute angle with the switch base;

a screw insertable through a portion of the base, the screw having a shaft disposed along a path of motion of the switch stem and the screw having an operational end for manual operation of the screw without the use of tools for movement of the screw between a withdrawn position and a clamping position in which the screw exerts a clamping action against said solid portion of the switch stem; and an angular cover which is movable between an open position and a closed position, wherein the cover forms an opening through which the structure forming the aperture projects when the cover is in the closed position, wherein the cover has two adjacent angular walls and side flap portions extending from the two adjacent angular walls, wherein the cover closes over the two angular surfaces of the base and the operational end of the screw to shield the operational end of the screw from access when the cover is in the closed position, and wherein the cover is secured in the closed position when a lock is positioned and is secured in said aperture.

2. The block-out device of claim 1 wherein the structure forming an aperture is a lug attached to the base.

3. The block-out device of claim 2, wherein the cover is hinged to the base.

4. The block-out device of claim 1, wherein the screw is a thumb screw that includes a knob on the operational end for manual operation of the screw without the use of tools.

5. A block-out device, for positioning over a switch that has a switch stem with a solid portion and a switch base, the block-out device having structure forming an aperture for receiving a lock, the block-out device comprising:

a base having an opening for receiving the switch stem when the base is positioned on the switch base;

a screw insertable through a portion of the base, the screw having a shaft disposed along a path of motion of the switch stem and the screw having an operational end for manual operation without the for movement of the screw between a withdrawn position and an engagement position in which the screw grips and immobilizes the switch stem; and a cover which is pivotably mounted on the base for movement between an open position and a closed position, wherein the cover forms an opening through which the structure forming the aperture projects when the cover is in the closed position, wherein the cover has two adjacent walls and side flap portions extending from the two adjacent walls, wherein the cover closes over the base and the operational end of the screw to shield the operational end of the screw from access when the cover is in the closed position, and wherein the cover is secured in the closed position when a lock is secured in said aperture.

6. The block-out device of claim 5 wherein the structure forming an aperture is a lug.

7. The block-out device of claim 5, wherein the screw is a thumb screw that includes a knob on the operational end for manual operation of the screw without the use of tools.

8. A block-out device for positioning over a switch that has a switch stem and a switch base, the block-out device having structure forming an aperture for receiving a lock, the block-out device comprising:

a base having an opening for receiving the switch stem when the base is positioned on the switch base;

a screw insertable through a portion of the base, the screw having an operational end for movement of the screw between a withdrawn position and an engagement position in which the screw grips and immobilizes the switch stem; and a cover which is pivotably mounted on the base for movement between an open position and a closed position, wherein the cover forms an opening through which the structure forming the aperture projects when the cover is in the closed position, wherein the cover closes over the base and screw to shield the operational end of the screw from access when the cover is in the closed position and wherein the cover is secured in the closed position, when a lock is secured in said aperture wherein the cover and the base are integrally formed with a portion of material that hinges the cover to the base.

* * * * *

UNITED STATES PATENT AND TRADEMARK OFFICE

CERTIFICATE OF CORRECTION

PATENT NO. : 5,500,495

DATED : March 19, 1996

INVENTOR(S) : Benda, Steven J. et al.

It is certified that error appears in the above-identified patent and that said Letters Patent is hereby corrected as shown below:

Column 2, line 3, shackle should be inserted between "lock" and "can".

Figure 7:
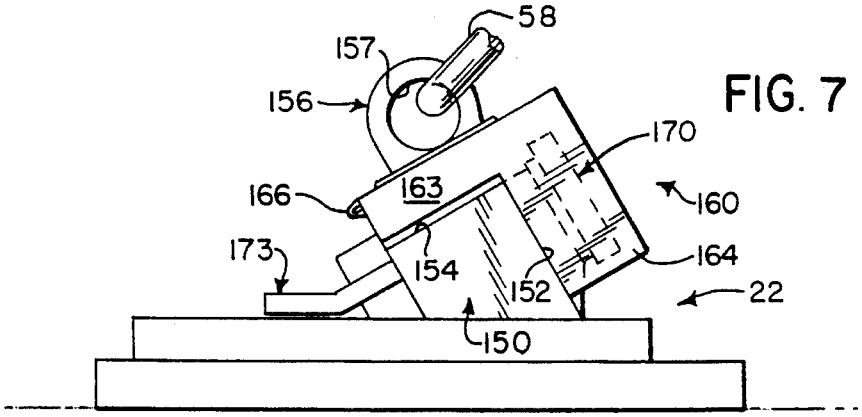
FIG. 7 s a side view in elevation of a third embodiment of the invention.

Column 2, line 54, after "FIG. 7", "s" should be --is--.

Column 4, line 24, "FIG. 15" should be --FIG. 5--.

Column 4, line 43, "FIG. 18" should be --FIG. 8--.

Figure 9:
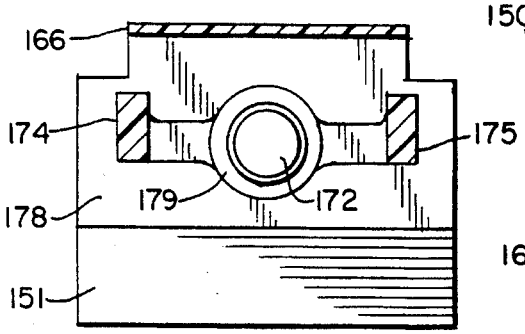
FIG. 9 is a sectional detail view taken in the plane indicated by line 9—9 in FIG. 8.
Figure 10:
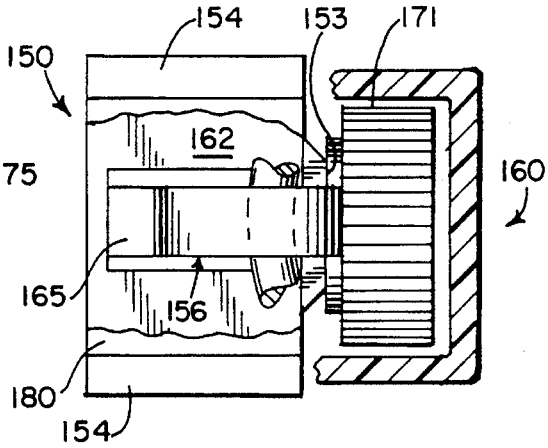
FIG. 10 is a view taken in the plane indicated by line 10—10 in FIG. 8.

Column 4, line 49, "FIG. 19" should be --FIG 9--.

Column 5, line 33, before "solid" insert --a--.

Signed and Sealed this

Thirteenth Day of August, 1996

*Attest:*

Bruce Lehman

BRUCE LEHMAN

*Attesting Officer*

*Commissioner of Patents and Trademarks*